US006677910B2

(12) United States Patent
Nakagawa

(10) Patent No.: US 6,677,910 B2
(45) Date of Patent: Jan. 13, 2004

(54) COMPACT PRIMARY RADIATOR

(75) Inventor: Masashi Nakagawa, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/091,356

(22) Filed: Mar. 5, 2002

(65) Prior Publication Data

US 2002/0175778 A1 Nov. 28, 2002

(30) Foreign Application Priority Data

Mar. 12, 2001 (JP) ..... 2001-068759

(51) Int. Cl.[7] ..... H01Q 13/00
(52) U.S. Cl. ..... 343/771; 343/786
(58) Field of Search ..... 343/771, 786, 343/776, 772; 333/21 A, 26, 254

(56) References Cited

U.S. PATENT DOCUMENTS

| | | | | |
|---|---|---|---|---|
| 5,216,432 A | | 6/1993 | West | 343/786 |
| 5,276,410 A | * | 1/1994 | Fukuzawa et al. | 333/21 A |
| 5,463,407 A | * | 10/1995 | West et al. | 343/786 |

FOREIGN PATENT DOCUMENTS

| | | |
|---|---|---|
| DE | 42 07 503 A1 | 9/1993 |
| DE | 43 05 906 A1 | 9/1994 |
| DE | 43 05 908 A1 | 9/1994 |
| JP | 5226906 | 9/1993 |
| JP | 946102 | 2/1997 |
| JP | 2000-349535 | 12/2000 |

* cited by examiner

*Primary Examiner*—James Clinger
(74) *Attorney, Agent, or Firm*—Brinks Hofer Gilson & Lione

(57) ABSTRACT

A waveguide has a circuit board disposed therein so that the circuit board is orthogonal to the waveguide axis, and the circuit board has a first probe and a second probe formed thereon for respectively extracting the vertically and horizontally polarized waves, and has a fine radiation pattern also formed thereon which intersects each of the axes of the first and second probes at about 45 degrees. The fine radiation pattern is disposed in the vicinity of the waveguide axis and is formed by patterning in a rectangular shape that is asymmetrical relative to each of the axes of the two probes. This configuration allows the fine radiation pattern having a relatively small shape to prevent the electric field of these polarized waves in the waveguide from being disturbed, thereby leading to a reduction in reflection of these polarized waves at the fine radiator while the radiator achieves sufficient isolation between the vertically and horizontally polarized waves.

1 Claim, 3 Drawing Sheets

COMPACT PRIMARY RADIATOR

BACKGROUND OF THE INVENTION

1. Field of the Invention

The present invention relates to a primary radiator for allowing a pair of probes disposed in a waveguide to selectively extract a vertically polarized wave and a horizontally polarized wave which are orthogonal to each other, and in particular, to a primary radiator having the pair of probes formed on a circuit board partly disposed in the waveguide.

2. Description of the Related Art

For example, in a satellite-television converter for receiving a left-hand circularly polarized wave and a right-hand circularly polarized wave transmitted for a satellite, the left-hand and right-hand circularly polarized waves are introduced into a waveguide and are converted into a vertically polarized wave and a horizontally polarized wave, respectively, at a 90-degree shifter, a pair of probes selectively extracts these polarized waves, and a converter circuit of the converter converts the frequencies of the received signals from the probes into signals having intermediate frequencies, thus allowing the converter to output the frequency-converted signals. By disposing the two probes apart from each other by a distance of about $\lambda/4$, where $\lambda$ is the wavelength in the waveguide, in the axial direction of the waveguide, there is provided an advantage on one hand in that sufficient isolation between the vertically and horizontally polarized waves is achieved, and there is provided a disadvantage on the other hand in that the primary radiator constituting the waveguide becomes longer in the axial direction thereof, thus hampering attempts to miniaturize the primary radiator. By disposing the two probes in a single plane which lies in the waveguide and which is orthogonal to the axis of the waveguide, there is provided an advantage on one hand in that the waveguide can be shortened in the axial direction thereof, and there is provided a disadvantage on the other hand in that sufficient isolation between the vertically and horizontally polarized waves is not achieved, thus giving rise to a problem of deteriorated cross polarization characteristics of these polarized waves.

As shown in FIG. 5, an exemplary configuration of the known probes is such that a waveguide 10 has a circuit board 11 disposed therein, which is orthogonal to the axis of the waveguide 10, and a cylindrical stub 10*a* disposed in a projecting manner on the terminal face thereof, and the circuit board 11 has a probe 12 and a probe 13, formed by patterning, on the same surface thereof for the vertically and horizontally polarized waves, respectively. In a primary radiator having such probes, the two probes 12 and 13 are formed by patterning on the same surface of the circuit board 11, thereby allowing the waveguide 10 to be shortened in the axial direction thereof, and moreover, the stub 10*a* disposed in a projecting manner on the terminal face of the waveguide 10 achieves sufficient isolation between the vertically and horizontally polarized waves.

As shown in FIG. 6, another exemplary configuration of the known probes is such that a fine radiation pattern 14 is formed in place of the above stub 10*a* on the same surface of the circuit board 11 as that on which the probes 12 and 13 are formed. This fine radiation pattern 14 is square or circular and is symmetrical relative to each of the axes of the probes 12 and 13. In the primary radiator having such probes, the fine radiation pattern 14 achieves sufficient isolation between the vertically and horizontally polarized waves while providing an advantage in that the waveguide 10 is shortened in the axial direction thereof.

However, the probe configuration shown in FIG. 5 has a problem in that forming an elongated stub on the terminal face of the waveguide in a projecting manner makes the waveguide structure complicated, and in particular, when the waveguide is formed from a metal plate, this makes it extremely difficult to form the stub on the metal plate. On the other hand, although there is provided an advantage in that eliminating the above stub makes the waveguide structure simple, the probe configuration shown in FIG. 6 has a problem in that a smaller size, i.e., a smaller area of the fine radiation pattern, leads to insufficient isolation between the vertically and horizontally polarized waves, thereby making it difficult to achieve excellent cross-polarization characteristics for these polarized waves; on the other hand, a larger size of the fine radiation pattern leads to increased reflection of the these polarized waves at the fine pattern, thereby resulting in increased transmission losses.

SUMMARY OF THE INVENTION

In view of the above background of the related art, it is an object of the present invention to provide a primary radiator which can be compact and simple, while achieving sufficient isolation between the vertically and horizontally polarized waves.

To achieve the above object, a primary radiator according to the present invention comprises the following elements: a waveguide for transmitting a vertically polarized wave and a horizontally polarized wave which are orthogonal to each other; a circuit board disposed in the waveguide so as to be orthogonal to the axis of the waveguide; a fine radiation pattern formed on the circuit board in the vicinity of the axis of the waveguide; and a first probe and a second probe formed on the circuit board and extending from the inner wall of the waveguide toward the fine radiation pattern. The first probe and the second probe are substantially orthogonal to each other, and the fine radiation pattern is electrically slanted at about 45 degrees relative to each of the axes of the first probe and the second probe.

In the primary radiator configured as described above, by disposing the fine radiation pattern formed on the circuit board so as to be electrically slanted at about 45 degrees relative to each of the axes of the first and second probes, the fine radiation pattern prevents the electric field of the vertically and horizontally polarized waves in the waveguide from being disturbed, thus leading to a reduction in reflection of these polarized waves thereat while maintaining sufficient isolation between these polarized waves.

In the primary radiator having above configuration, the fine radiation pattern may have a strip shape, such as a rectangular shape and an elliptical shape, extending along a direction slanted at about 45 degrees relative to each of the axes of the first probe and the second probe. Alternatively, the fine radiation pattern may have an L-shape having a first arm and a second arm which are substantially orthogonal to each other and which are electrically slanted at about 45 degrees relative to each of the axes of the first probe and the second probe.

Thus, the present invention has the following advantages.

A circuit board is disposed in a waveguide, in which a vertically polarized wave and a horizontally polarized wave propagate, so as to be orthogonal to the axis of the waveguide, has a first probe and a second probe formed thereon for respectively extracting the vertically and horizontally polarized waves, and also has a fine radiation pattern formed thereon electrically slanted at about 45 degrees relative to each of the axes of the first and second probes. This configuration allows a fine radiation pattern having a relatively small size to prevent the electric field of the vertically and horizontally polarized waves in the waveguide from being disturbed and also these polarized waves from being reflected thereat, while maintaining sufficient isolation between these polarized waves.

BRIEF DESCRIPTION OF THE DRAWINGS

FIGS. 5A and 5B illustrate a known primary radiator, wherein FIG. 5A is a sectional view illustrating a probe configuration on the circuit board and FIG. 5B is a view through the line VB—VB of the probe configuration in FIG. 5A; and FIGS. 6A and 6B illustrate another known primary radiator, wherein FIG. 6A is a sectional view illustrating a probe configuration and FIG. 6B is a view through the line VIB—VIB of the probe configuration in FIG. 6A.

DESCRIPTION OF THE PREFERRED EMBODIMENTS

Figure 1:
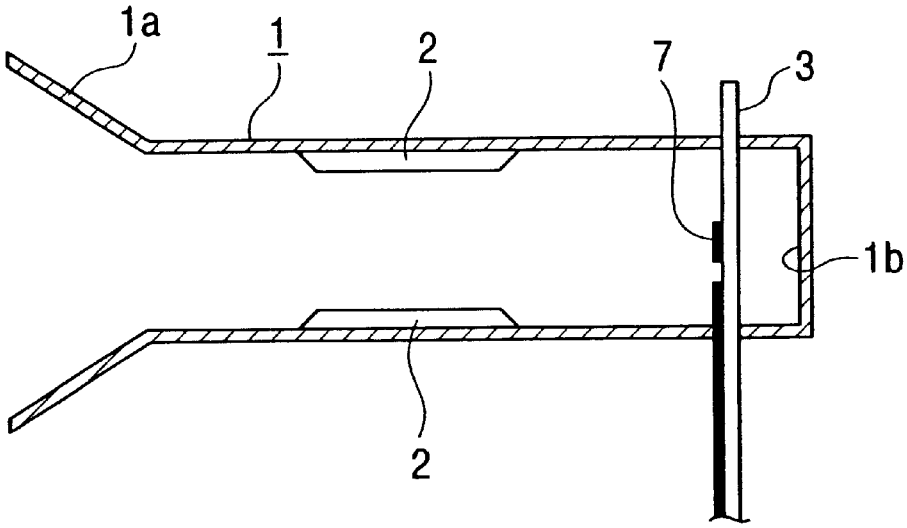
FIG. 1 is a schematic sectional view illustrating a primary radiator according to an embodiment of the present invention.
Figure 2:
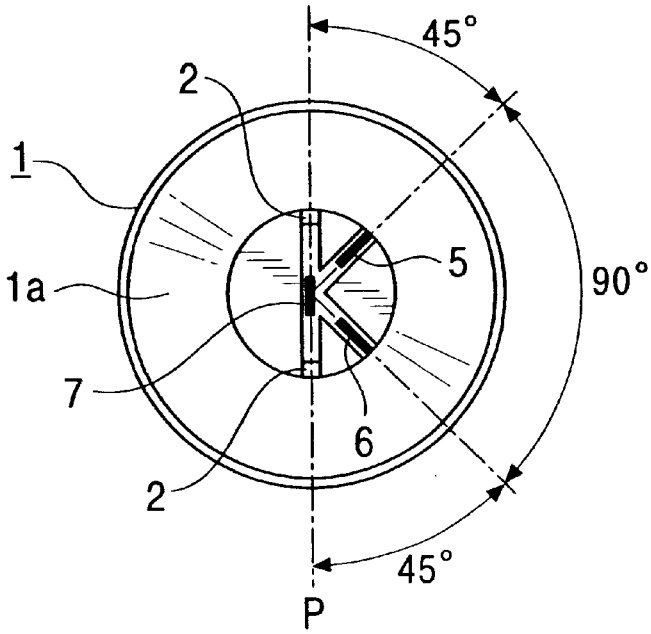
FIG. 2 is an elevational view of the primary radiator viewed from a horn of the primary radiator.
Figure 3:
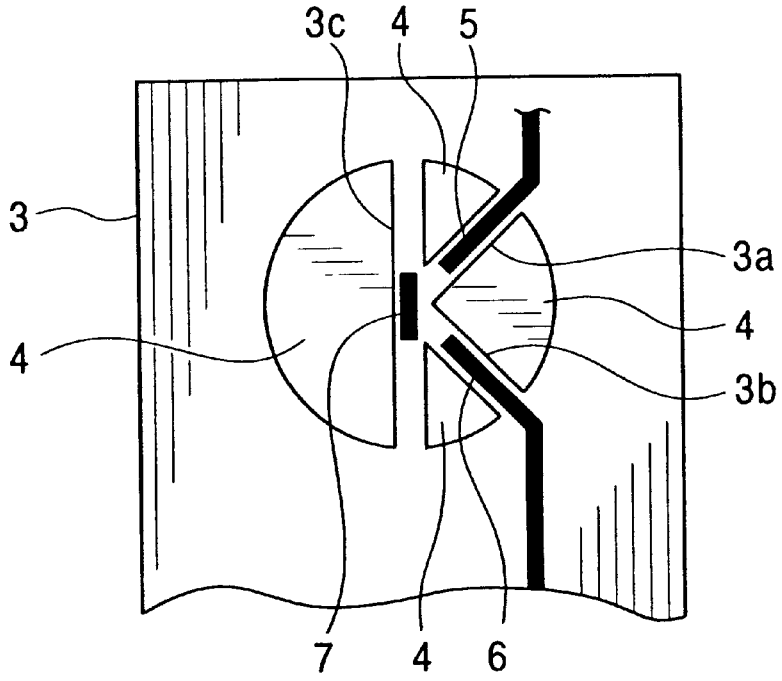
FIG. 3 is an illustration of a circuit board provided in the primary radiator.

Referring now to the accompanying drawings, an embodiment of the present invention will be described. FIG. 1 is a schematic sectional view illustrating a primary radiator according to an embodiment of the present invention. FIG. 2 is an elevational view of the primary radiator viewed from a horn of the primary radiator. FIG. 3 is an illustration of a circuit board provided in the primary radiator.

As shown in these drawings, the primary radiator according to the embodiment comprises a tubular waveguide 1 having a horn 1*a* at one end and a terminal face 1*b* at the other end, a pair of ridges 2 projecting from the inner wall of the waveguide 1 toward the axis of the waveguide 1, and a circuit board 3 partly inserted in the waveguide 1, wherein the plane of the circuit board 3 is orthogonal to the waveguide axis. The pair of ridges 2 serves as a 90-degree phase shifter so that a left-hand circularly polarized wave and a right-hand circularly polarized wave entering the waveguide 1 are converted to a vertically polarized wave and a horizontally polarized wave, respectively. A dielectric plate may be used as a 90-degree phase shifter instead of the pair of ridges 2.

The circuit board 3 has a plurality of perforations 4 perforated therethrough and lying inside the waveguide 1 for forming a first bridge 3*a*, a second bridge 3*b*, and a third bridge 3*c*. The first and second bridges 3*a* and 3*b* intersect with each other at about 90 degrees and extend from the inner wall of the waveguide 1 toward the axis of the waveguide 1 so as to connect to the third bridge 3*c*. The third bridge 3*c* intersects each of the first and second bridges 3*a* and 3*b* at about 45 degrees and extends between opposing points on the inner wall of the waveguide 1. On one side of the circuit board 3, a first probe 5 lying on the first bridge 3*a*, a second probe 6 lying on the second bridge 3*b*, and a fine radiation pattern 7 lying on the third bridge 3*c* are formed by patterning. Though not shown in the drawings, on the other side of the circuit board 3, a grounding pattern is formed thereon except the areas for the first to third bridges 3*a* to 3*c*. Also, though not shown in the drawings, on the one side of the circuit board 3, another grounding pattern, a micro-strip wiring, circuit elements for a converter circuit, and so forth are formed. These grounding patterns formed on both sides of the circuit board 3 are electrically connected to each other via through-holes.

The circuit board 3 is separated from the terminal face 1*b* of the waveguide 1 by about a quarter of the wavelength in waveguide. The terminal face 1*b* serves as a reflection surface of the probes 5 and 6. The first and second probes 5 and 6 respectively receive the vertically and horizontally polarized waves propagating in the waveguide 1 and are substantially orthogonal to each other in the waveguide 1. In this embodiment, the probes 5 and 6 are set to intersect with each other at an angle slightly smaller that 90 degrees so that the leading edges of the probes 5 and 6 are kept as far away from each other as possible. As shown in FIG. 2, when a plane including the axis of the waveguide 1 and the two ridges 2 is designated as a reference plane P, the probes 5 and 6 each intersect the reference plane P at about 45 degrees. The fine radiation pattern 7 has a rectangular shape extending substantially parallel to the reference plane P and opposes the leading edges of the probes 5 and 6 on the circuit board 3 while keeping a predetermined distance away from these leading edges. The fine radiation pattern 7 has a longitudinal axis intersecting each of the axes of the probes 5 and 6 at about 45 degrees and is formed to be asymmetrical relative to each of the axes of the probes 5 and 6.

In the primary radiator as configured above, a left-hand circularly polarized wave and a right-hand circularly polarized wave transmitted from a satellite enter the waveguide 1 via the horn 1*a* and are converted to linearly polarized waves by the two ridges 2 while propagating in the waveguide 1. That is to say, a circularly polarized wave is a rotating polarized wave that is a combination of the vectors of two linearly polarized waves that have the same amplitude and a 90-degree phase difference from each other. Accordingly, the circularly polarized wave having the above 90-degree phase difference is converted to the polarized wave having a common mode while passing through the two ridges 2, for example, the left-hand circularly polarized wave is converted to a vertically polarized wave and the right-hand circularly polarized wave is converted to a horizontally polarized wave. The first and second probes 5 and 6 respectively extract the vertically and horizontally polarized waves travelling in the waveguide 1 toward the terminal face 1*b*. Then, a converter circuit converts the frequencies of the output signals of the probes 5 and 6 into intermediate frequency signals, thus allowing the left-hand circularly and right-hand circularly polarized waves to be received.

The fine radiation pattern 7 is formed on the circuit board 3 so as to oppose the leading edges of the probes 5 and 6 at a predetermined distance, and intersects each of the axes of the probes 5 and 6 at about 45 degrees. This configuration allows the fine radiation pattern 7 to prevent the electric field of the vertically and horizontally polarized waves from being disturbed, thus achieving sufficient isolation between the vertically and horizontally polarized waves. Also, the fine radiation pattern 7 is rectangular and asymmetrical relative to each of the axes of the probes 5 and 6, and also is set to have a relatively small size, i.e., a relatively small area, thus preventing the vertically and horizontally polarized waves from being reflected thereat, while maintaining sufficient isolation between these polarized waves. Moreover, forming the two probes 5 and 6 and the fine radiation pattern 7, respectively, on the first, second, and third bridges 3*a* to 3*c*, which are connected to each other, improves the mechanical strength of the probes 5 and 6.

Figure 4A:
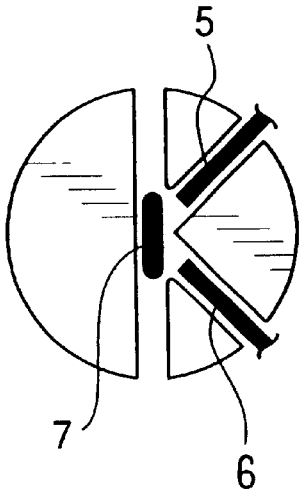
FIGS. 4A to 4C are illustrations of modifications of a fine radiation pattern on the circuit board.
Figure 4B:
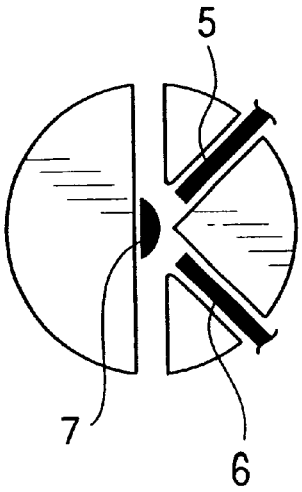
Figure 4C:
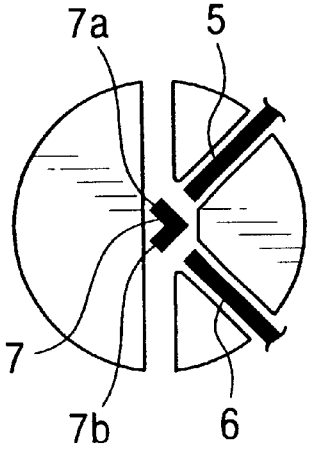
Figure 5A:
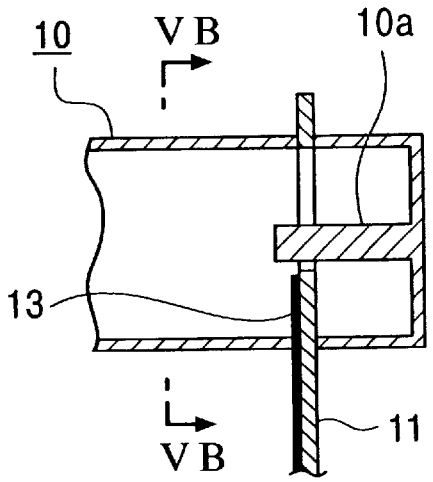
FIG. 5A PRIOR ART
Figure 5B:
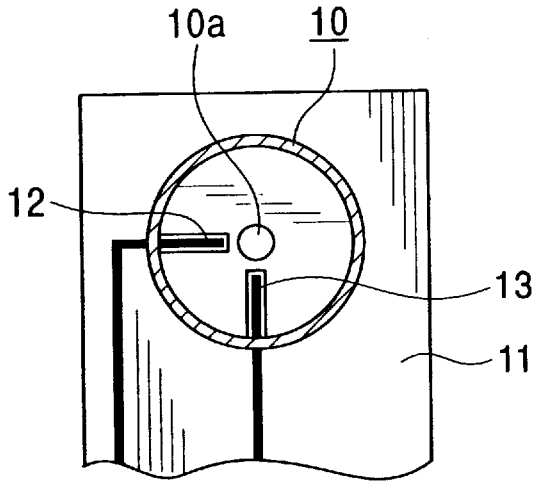
FIG. 5B PRIOR ART
Figure 6A:
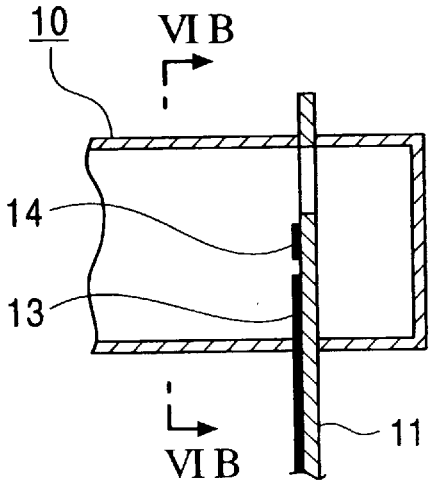
FIG. 6A PRIOR ART
Figure 6B:
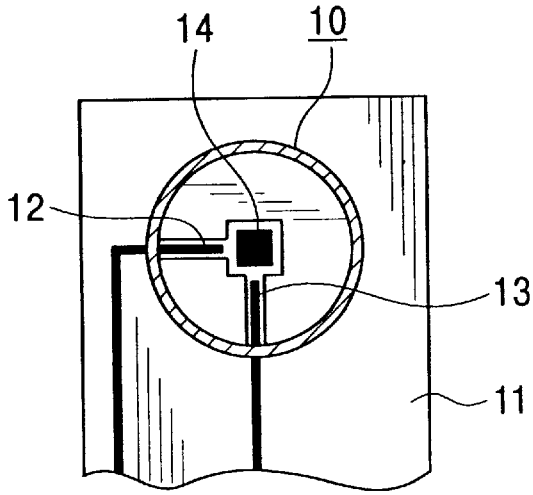
FIG. 6B PRIOR ART

The fine radiation pattern 7 is not limited to having a rectangular shape in the foregoing embodiment, but may have an elliptical shape or a crescent shape, as shown in FIG. 4A or FIG. 4B, respectively. Alternatively, the fine radiation pattern 7 may have an L-shape having two arms 7*a* and 7*b* which are substantially orthogonal to each other and which are electrically slanted at about 45 degrees relative to each of the axes of the probes 5 and 6. The point is that the fine radiation pattern 7 is electrically slanted at about 45 degrees relative to each of the axes of the first and second probes 5 and 6.

What is claimed is:

1. A primary radiator comprising:

a waveguide to transmit a vertically polarized wave and a horizontally polarized wave which are orthogonal to each other;

a circuit board disposed in the waveguide so as to be orthogonal to an axis of the waveguide;

a fine radiation pattern formed in an electrically independent manner on the circuit board and in the vicinity of the axis of the waveguide; and a first probe and a second probe formed on the same surface of the circuit board as that on which the fine radiation pattern is formed and extending from an inner wall of the waveguide toward the fine radiation pattern, wherein the first probe and the second probe are substantially orthogonal to each other, and the fine radiation pattern is electrically slanted at about 45 degrees relative to each of axes of the first probe and the second probe.

* * * * *